US008523087B2

(12) United States Patent
Hagaman

(10) Patent No.: US 8,523,087 B2
(45) Date of Patent: Sep. 3, 2013

(54) SURFACE DISRUPTOR FOR LAMINAR JET FOUNTAIN

(75) Inventor: John T. Hagaman, West Hills, CA (US)

(73) Assignee: Zodiac Pool Systems, Inc., Vista, CA (US)

( * ) Notice: Subject to any disclaimer, the term of this patent is extended or adjusted under 35 U.S.C. 154(b) by 130 days.

(21) Appl. No.: 13/279,968

(22) Filed: Oct. 24, 2011

(65) Prior Publication Data

US 2012/0037235 A1 Feb. 16, 2012

Related U.S. Application Data

(60) Division of application No. 12/396,466, filed on Mar. 2, 2009, now Pat. No. 8,042,748, which is a continuation-in-part of application No. 12/340,520, filed on Dec. 19, 2008, now Pat. No. 8,177,141.

(51) Int. Cl.

| | |
|---|---|
| ***B05B 17/08*** | (2006.01) |
| ***B05B 17/04*** | (2006.01) |
| ***B05B 1/26*** | (2006.01) |
| ***F21S 8/00*** | (2006.01) |

(52) U.S. Cl.

USPC ..... 239/12; 239/11; 239/17; 239/18; 239/420; 239/433; 239/543; 239/590

(58) Field of Classification Search

USPC ..... 239/11, 12, 16–18, 20–23, 69, 200, 239/201, 211, 276, 282, 283, 285, 398, 418, 239/420, 426, 433, 434, 461, 462, 543–545, 239/548, 562, 565, 580, 590, 590.3; 362/96, 362/318

See application file for complete search history.

(56) References Cited

U.S. PATENT DOCUMENTS

| | | | |
|---|---|---|---|
| 766,165 | A | 8/1904 | Beitten |
| 895,668 | A | 8/1908 | Newman |

(Continued)

FOREIGN PATENT DOCUMENTS

| | | |
|---|---|---|
| DE | 2641802 | 3/1978 |
| EP | 275084 | 7/1988 |

OTHER PUBLICATIONS

Jandy 2007 Pool and Spa Products Catalog, Water Features, pp. 155-178, plus Introduction and Table of Contents (4 pages), Jandy Pool Products, Inc.

(Continued)

*Primary Examiner* — Darren W Gorman
(74) *Attorney, Agent, or Firm* — Dorsey & Whitney LLP

(57) ABSTRACT

A fluid handling device, for example, a laminar jet fountain, includes a jet emanating a first stream of substantially laminar fluid. The jet fountain also includes a surface disruptor that includes a body, a water inlet, a valve, a fluid outlet, and a trajectory adjuster emanating a second stream of fluid from the fluid outlet. The second stream of fluid may be positioned to intersect the first stream of fluid and perturb its laminarity. By adjusting a valve controlling the force and volume of flow of the second stream and/or by adjusting the trajectory adjuster, the intersection of the first and second streams may be modified and, therefore, the laminarity of the first stream may be modified. By disrupting the laminar surface of the first stream, light introduced into the first stream may be caused to refract outward from the first stream and thus enhance illumination of the first stream.

19 Claims, 24 Drawing Sheets

(56) References Cited

U.S. PATENT DOCUMENTS

| | | | |
|---|---|---|---|
| 1,184,827 | A | 5/1916 | Coto-Ston |
| 1,198,303 | A | 9/1916 | Williams |
| 1,504,851 | A | 8/1924 | Wren |
| 1,624,081 | A | 4/1927 | Taylor |
| 1,804,001 | A | 5/1931 | Eck |
| 2,051,382 | A | 8/1936 | King |
| 2,147,925 | A | 2/1939 | Schwalbe |
| 2,364,848 | A | 12/1944 | Hurst |
| 2,642,813 | A | 2/1950 | Woodruff et al. |
| 2,499,966 | A | 3/1950 | Neely |
| 3,022,016 | A | 2/1962 | Shrewsbury |
| 3,088,675 | A | 5/1963 | Bone |
| 3,385,526 | A | 5/1968 | Furrer |
| 3,690,554 | A | 9/1972 | Hruby, Jr. |
| 3,705,686 | A | 12/1972 | Hruby, Jr. |
| 3,730,439 | A | 5/1973 | Parkison |
| 3,730,440 | A | 5/1973 | Parkison |
| 3,782,629 | A | 1/1974 | Hruby, Jr. |
| 3,785,559 | A | 1/1974 | Hruby, Jr. |
| 3,820,716 | A | 6/1974 | Bauer |
| 3,851,825 | A | 12/1974 | Parkison et al. |
| 3,858,620 | A | 1/1975 | Hruby, Jr. |
| 3,949,213 | A | 4/1976 | Paitchell |
| 4,002,293 | A | 1/1977 | Simmons |
| 4,119,276 | A | 10/1978 | Nelson |
| 4,269,352 | A | 5/1981 | Przystawik |
| 4,334,328 | A | 6/1982 | Delepine |
| 4,443,899 | A | 4/1984 | Johnson |
| 4,502,304 | A | 3/1985 | Hopkins |
| 4,503,563 | A | 3/1985 | Johnson |
| 4,520,514 | A | 6/1985 | Johnson |
| 4,593,420 | A | 6/1986 | Tobias et al. |
| 4,689,827 | A | 8/1987 | Gurney, Jr. |
| 4,730,786 | A | 3/1988 | Nelson |
| 4,742,965 | A | 5/1988 | Messinger et al. |
| 4,750,993 | A | 6/1988 | Donhauser et al. |
| 4,795,092 | A | 1/1989 | Fuller |
| 4,877,084 | A | 10/1989 | Goggin |
| 4,881,280 | A | 11/1989 | Lesikar |
| 4,912,782 | A | 4/1990 | Robbins |
| 4,941,217 | A | 7/1990 | Tobias et al. |
| 4,955,540 | A | 9/1990 | Fuller et al. |
| 4,982,460 | A | 1/1991 | Tobias et al. |
| 4,983,517 | A | 1/1991 | Kim et al. |
| 4,985,943 | A | 1/1991 | Tobias et al. |
| 5,078,320 | A | 1/1992 | Fuller et al. |
| 5,095,558 | A | 3/1992 | Howard |
| 5,115,973 | A | 5/1992 | Fuller et al. |
| 5,115,974 | A | 5/1992 | Tobias et al. |
| 5,127,111 | A | 7/1992 | Sieth |
| 5,169,065 | A | 12/1992 | Bloch |
| 5,207,499 | A | 5/1993 | Vajda et al. |
| 5,231,865 | A | 8/1993 | McDermott et al. |
| 5,242,119 | A | 9/1993 | Jariyasunant |
| 5,271,561 | A | 12/1993 | Tobias et al. |
| 5,309,581 | A | 5/1994 | Lockwood et al. |
| 5,431,342 | A | 7/1995 | Saripalli et al. |
| 5,432,688 | A | 7/1995 | Tobias et al. |
| 5,537,696 | A | 7/1996 | Chartier |
| 5,607,224 | A | 3/1997 | Tobias et al. |
| 5,658,723 | A | 8/1997 | Oberhardt |
| 5,738,280 | A | 4/1998 | Ruthenberg |
| 5,884,871 | A | 3/1999 | Fedorov et al. |
| 5,893,179 | A | 4/1999 | Johnson |
| 6,196,471 | B1 | 3/2001 | Ruthenberg |
| 6,209,586 | B1 | 4/2001 | Wright |
| 6,250,570 | B1 | 6/2001 | Starr et al. |
| 6,322,004 | B1 | 11/2001 | Perdreau et al. |
| 6,340,035 | B2 | 1/2002 | Wright |
| 6,379,025 | B1 | 4/2002 | Mateescu et al. |
| 6,393,771 | B1 | 5/2002 | Stetson |
| 6,431,170 | B1 | 8/2002 | Truitt et al. |
| 6,439,472 | B1 | 8/2002 | Lin et al. |
| 6,470,509 | B1 | 10/2002 | Ayeni |
| 6,471,146 | B1 | 10/2002 | Kuykendal et al. |
| 6,484,953 | B2 | 11/2002 | Freier |
| 6,491,238 | B1 | 12/2002 | Swanson |
| 6,557,588 | B2 | 5/2003 | Wright |
| 6,565,011 | B1 | 5/2003 | Kuykendal et al. |
| 6,611,114 | B1 | 8/2003 | Yen |
| 6,641,056 | B2 | 11/2003 | Kuykendal et al. |
| 6,676,031 | B2 | 1/2004 | Kuykendal et al. |
| 6,691,336 | B2 | 2/2004 | Buck |
| 6,798,154 | B1 | 9/2004 | Sullivan et al. |
| 6,805,458 | B2 | 10/2004 | Schindler et al. |
| 6,811,286 | B2 | 11/2004 | Mateescu et al. |
| 6,857,746 | B2 | 2/2005 | Dyner |
| 6,973,681 | B2 | 12/2005 | Ayeni et al. |
| 7,012,384 | B2 | 3/2006 | Tatewaki et al. |
| 7,023,147 | B2 | 4/2006 | Colby et al. |
| 7,055,988 | B2 | 6/2006 | Mateescu et al. |
| 7,097,329 | B2 | 8/2006 | Mateescu et al. |
| 7,125,146 | B2 | 10/2006 | Willis et al. |
| 7,128,440 | B2 | 10/2006 | Mateescu et al. |
| 7,188,378 | B2 | 3/2007 | Ryan |
| 7,204,602 | B2 | 4/2007 | Archer |
| 7,214,029 | B2 | 5/2007 | Richter |
| 7,264,176 | B2 | 9/2007 | Johnson |
| 7,293,300 | B2 | 11/2007 | Kunkel et al. |
| 7,316,359 | B2 | 1/2008 | Beidokhti |
| 7,341,203 | B1 * | 3/2008 | Yeomans et al. ..... 239/20 |
| 7,381,129 | B2 | 6/2008 | Avedon |
| 7,404,649 | B2 | 7/2008 | Gosis et al. |
| 7,514,884 | B2 | 4/2009 | Potucek et al. |
| 2002/0088869 | A1 | 7/2002 | Simmons |
| 2003/0010836 | A1 | 1/2003 | Pham |
| 2003/0156422 | A1 | 8/2003 | Tatewaki et al. |
| 2004/0129794 | A1 | 7/2004 | Deichmann |
| 2005/0088119 | A1 | 4/2005 | Potucek et al. |
| 2006/0002104 | A1 | 1/2006 | Willis et al. |
| 2006/0092636 | A1 | 5/2006 | Potucek et al. |
| 2006/0102757 | A1 | 5/2006 | Johnson |
| 2006/0163374 | A1 | 7/2006 | Wooten |
| 2006/0175423 | A1 | 8/2006 | White et al. |
| 2006/0175424 | A1 | 8/2006 | Tatum |
| 2006/0291213 | A1 | 12/2006 | Mateescu et al. |
| 2007/0139910 | A1 | 6/2007 | Gosis et al. |
| 2007/0159833 | A1 | 7/2007 | Netzel, Sr. et al. |
| 2008/0128027 | A1 | 6/2008 | Hyde et al. |
| 2008/0128560 | A1 | 6/2008 | Hyde et al. |
| 2008/0128561 | A1 | 6/2008 | Hyde et al. |
| 2010/0155497 | A1 | 6/2010 | Hagaman |
| 2010/0155498 | A1 | 6/2010 | Hagaman |

OTHER PUBLICATIONS

Jandy 2008 Pool and Spa Products Catalog, Water Features, pp. 173-194, plus Introduction and Table of Contents (5 pages), Jandy Pool Products, Inc.

Jandy AquaLink™ RS One Touch™ Control Systems, Owner's Manual, known at least as early as Dec. 19, 2008, 60 pages.

Jandy Laminar Jet Part #JLJ1001, Laminar Jet Reference Guide, known at least as early as Dec. 19, 2008, 1 page.

Jandy Laminar Jets & Deck Jets, Sell Sheet, 2006, 2 pages.

Jandy™ Laminar Jet with Deck Box, Installation and Operation Manual, known at least as early as Dec. 19, 2008, 12 pages, Moorpark, California.

Jandy™ WaterColors LED, Underwater Large and Small Light, Installation Manual, 2008, 20 pages, Moorpark, California.

MagicStream™ Laminar Installation and User's Guide, Pentair Water Pool and Spa, Inc., 2008, Sanford, NC and Moorpark, CA, 20 pages.

Pour-A-Lid Masonry Deck Products Home Page and Products Page, accessed at www.pouralid.com on Aug. 27, 2010 (known at least as early as Mar. 3, 2008), 2 pages.

Zodiac 2009 Product Catalog, Water Features, pp. 81-110, plus Introduction and Table of Contents (9 pages), Zodiac Pool Systems, Inc.

Zodiac 2010 Product Catalog, Water Features, pp. 197-226, plus Introduction and Table of Contents (5 pages), Zodiac Pool Systems, Inc.

* cited by examiner

SURFACE DISRUPTOR FOR LAMINAR JET FOUNTAIN

CROSS REFERENCE TO RELATED APPLICATIONS

This application is a divisional of U.S. patent application Ser. No. 12/396,466 filed Mar. 2, 2009 entitled "Surface disruptor for laminar jet fountain, which is a continuation-in-part of U.S. patent application Ser. No. 12/340,520 filed 19 Dec. 2008 entitled "Laminar deck jet," which applications are hereby incorporated herein by reference in their entireties.

TECHNICAL FIELD

The present invention relates generally to water handling devices for pools and spas, and more particularly to water handling devices for pools and spas with enhanced mechanical, lighting, and/or flow features.

BACKGROUND

Water handling devices may be used in a variety of settings. For example, water handling devices may be used in decorative displays that range from residential pools in a homeowner's backyard to commercial water displays of the type seen in amusement parks. Some of these decorative displays may include jets that project water supplied from a body of water back into the body of water or into a secondary body of water. In order to contribute to the overall aesthetic appeal of the decorative display, these jets may be implemented beneath grade and/or out of the sight of an observer viewing the decorative display. Because the jets may be employed beneath grade, however, they may be particularly difficult to construct and/or maintain. For example, some jets may be housed beneath grade and covered with a lid that allows the water from the jet to escape through an aperture in the lid. In these embodiments, the jet may be suspended from the lid itself, which may make it difficult to adjust and maintain the jet.

Visual effects achieved using these jets may vary based upon the type of jet used. For example, some of these jets, termed herein as "laminar jets", may project substantially laminar water flow back into the body of water. To add to the overall aesthetic appeal, some embodiments may couple sources of light into this laminar water flow. Unfortunately, because of the smooth surface of the laminar water flow and the straight columnar segments of the water flow, light coupled into the laminar water flow may be difficult to see.

Accordingly, there is a need for water handling devices with enhanced features that solve one or more of the foregoing problems.

The information included in this Background section of the specification, including any references cited herein and any description or discussion thereof, is included for technical reference purposes only and is not to be regarded as subject matter by which the scope of the invention is to be bound.

SUMMARY

Methods and apparatuses are disclosed for fluid handling devices with enhanced functionality, such as fountains. In some embodiments, the fluid handling devices may include a plurality of filters coupled to the fluid handling device. When a first stream of fluid is passed through the plurality of filters, the laminarity of the first stream of fluid is improved. The fluid handling device also includes a surface disruptor that emanates a second stream of fluid. If the second stream of fluid is positioned so as to intersect the first stream of fluid, the laminarity of the first stream of fluid is perturbed. When a light source is included in the jet, the appearance of the light in the first stream may be modified as its laminarity is modified. For example, light introduced into the first stream of fluid may be caused to refract outward from the first stream of fluid and thus enhance illumination of the first stream of fluid.

In some embodiments, the disruptor may include an adjustment mechanism, such as a trajectory adjuster, for adjusting the angular intersection of the first and second streams, and therefore, cause changes in the laminarity of the first stream of fluid to create different lighting effects. In still other embodiments, the disruptor may include a screw-type valve that allows the force of the second stream of fluid to vary the laminarity of the first stream of fluid and create different lighting effects.

Other embodiments may include a method of operating a water handling device, such as a fountain, so as to produce different visual effects for light contained within the fluid emanated from the fountain. The method may include including passing a first stream of fluid through a plurality of filters in the water handling device and ejecting the first stream of fluid from the water handling device creating a substantially laminar fluid stream. The laminarity of the first stream of fluid may be modified by using a second stream of fluid. When a light source is used to introduce light within the first laminar stream of fluid, the disruption of the laminar surface by the second stream of fluid may cause this light to be refracted outward from the first stream of fluid and enhance illumination of the first stream of fluid. In some embodiments, this second stream of fluid is derived, at least in part, from the first stream.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the present invention will be apparent from the following more particular written description of various embodiments of the invention as further illustrated in the accompanying drawings and defined in the appended claims.

BRIEF DESCRIPTION OF THE DRAWINGS

The use of the same reference numerals in different drawings indicates similar or identical items.

DETAILED DESCRIPTION OF THE INVENTION

Although one or more of these embodiments may be described in detail, the embodiments disclosed should not be interpreted or otherwise used as limiting the scope of the disclosure, including the claims. Further, to the extent that certain implementations are disclosed as "exemplary", it should be understood that these are merely representations of possible implementations rather than the only possible implementation. Also, although the terms "fluid" and "water" may be used interchangeably herein, it should be appreciated that this disclosure applies to devices operating on all types of fluids and not just water. Furthermore, the term "laminar jet", as used herein, refers to a fluid handling device capable of projecting fluids in a coherent column or tubular form in a substantially laminar state. In addition, one skilled in the art will understand that the following description has broad application. Accordingly, the discussion of any embodiment is meant only to be exemplary and is not intended to intimate that the scope of the disclosure, including the claims, is limited to these embodiments.

Embodiments are disclosed that may allow for improved laminar jet operations and/or functionality. In some embodiments, the laminar jet may be mounted to a collar of a housing rather than the lid of the housing. By mounting the laminar jet to a collar of the housing rather than the lid of the housing, the laminar jet may be more easily removed from the housing. Other embodiments may include one or more mechanisms for adjusting the flow rate of the laminar jet without having to remove the laminar jet from its housing. In still other embodiments, the laminar jet may include light emitting diodes (LEDs) that may be synchronized to LEDs in other laminar jets so as to operate in concert as a synchronized system. Further still, some embodiments may include a surface disruptor that may perturb laminar flow coming out of the laminar jet and, thereby, may enhance lighting that is coupled with the laminar flow.

Figure 1A:
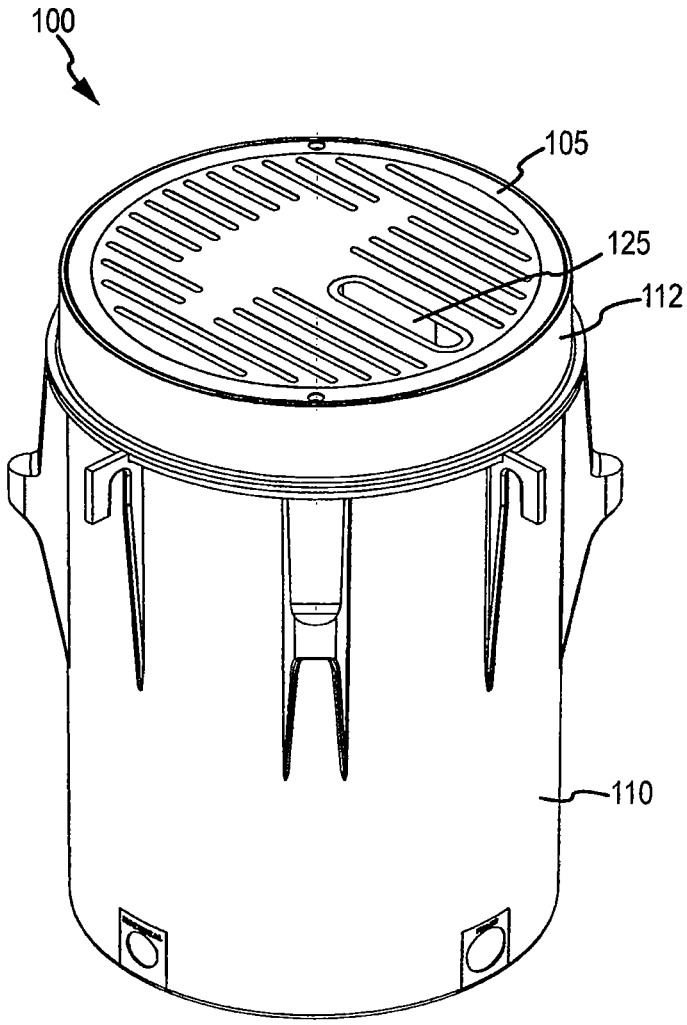
FIG. 1A illustrates an exemplary housing for a fluid handling device.

FIG. 1A illustrates an exemplary housing 100 for a fluid handling device, e.g., a laminar jet fountain. The housing 100 may include a lid 105 coupled to a canister 110 via a collar 112. Embodiments of the lid 105 may include lids where the top is a vacant cavity that is filled with aggregate to match a surrounding grade, such as the POUR-A-LID manufactured by Stetson Development, Inc.

Figure 1B:
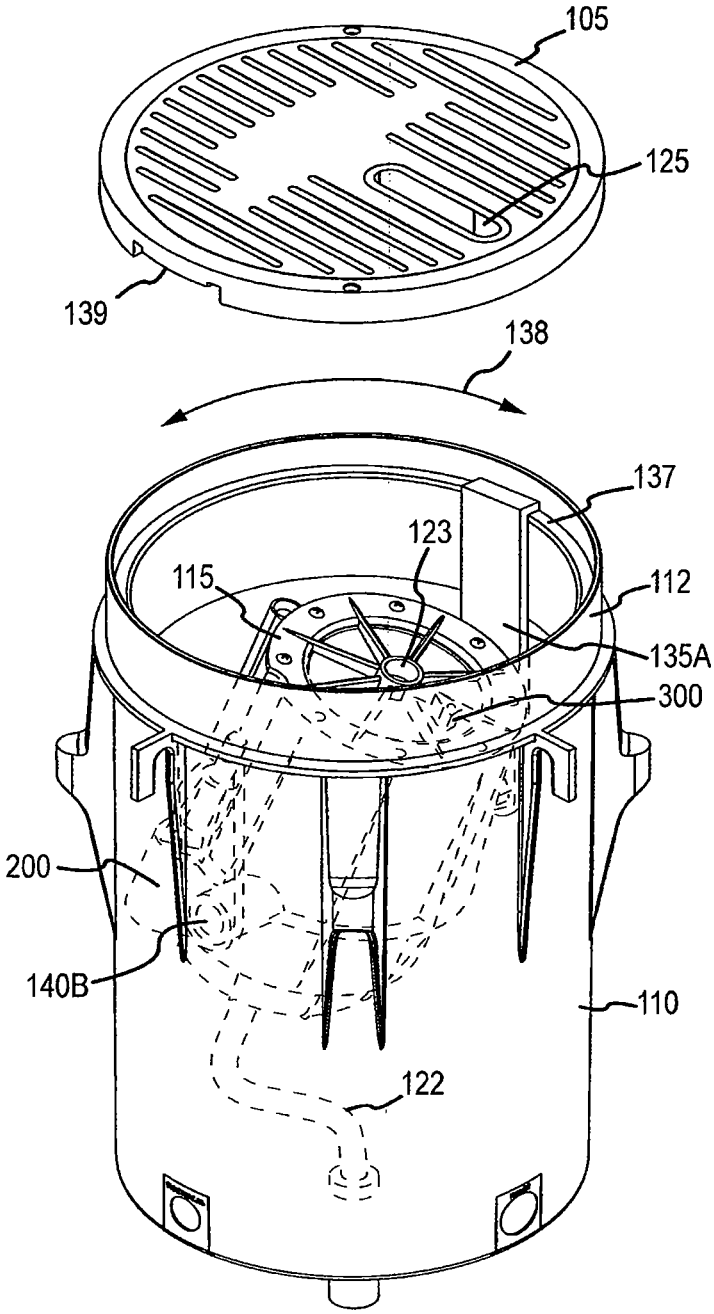
FIG. 1B illustrates an exemplary water handling device in phantom within the exemplary housing of FIG. 1A.

The housing 100 also may contain a variety of water handling devices. FIG. 1B illustrates a laminar jet 115 in phantom as but one of the many such water handling devices that may be implemented in the housing 100. For the sake of discussion, this disclosure will focus on embodiments employing the laminar jet 115, however, it should be appreciated that the principles disclosed herein apply to a wide variety of water handling devices.

Regardless of the particular water handling device implemented, the housing 100 may be situated about a body of water 120 as shown in the FIG. 10. Although two housings 100 and/or water handling devices are shown situated about the body of water 120, it should be appreciated that a variety of numbers of housings 100 and/or water handling devices are possible. During operation, water may be drawn from the body of water 120 via a water supply line 122. Water from the supply line 122 may be drawn into the laminar jet 115 (situated within the housing 100 shown in FIG. 10) where it is then projected through an orifice 123 in the laminar jet 115 (shown in FIG. 1B) and out of the housing 100 via an opening 125 in the lid 105 (shown in FIG. 1B). In some embodiments, water from the supply line 122 is drawn from the body of water 120 using a pump 121 that is separate from the laminar jet 115. Thus, in some embodiments, the water in the supply line 122 may be pressurized prior to entering the laminar jet 115. In other embodiments, the laminar jet 115 may be integrated with a pump that draws water from the body of water 120 through the supply line 122 and into the laminar jet 115.

Figure 1C:
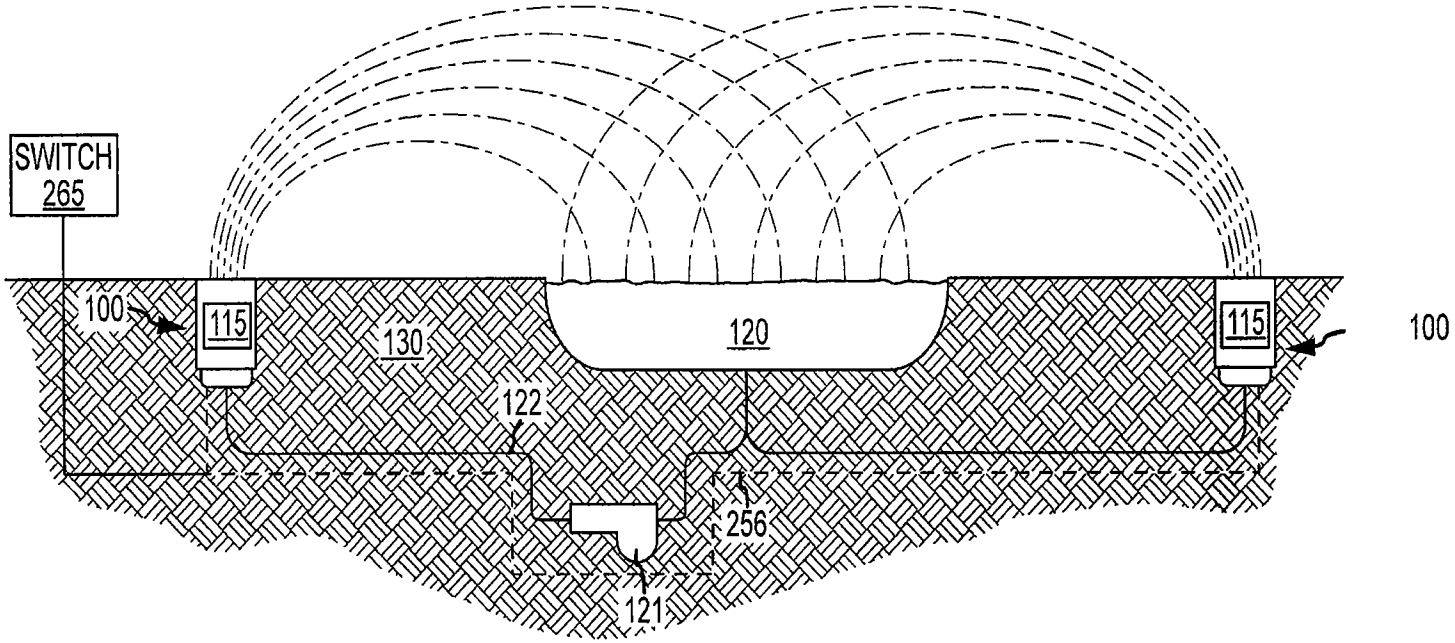
FIG. 1C illustrates the exemplary water handling device of FIG. 1B situated about a body of water.

Depending upon the configuration of the water handling device and/or the lid 105, the water exiting the opening 125 may follow a variety of adjustable trajectories as shown in FIG. 1C. As shown in the exemplary embodiment of FIG. 1C, the top surface or lid of the housing 100 may be positioned in a cavity in a deck 130 surrounding the canister 110 and the collar 112. In this manner, the housing 100 may be substantially flush with the surface of the deck 130 and allow it to be concealed during operation. In addition, by implementing the top of the housing 100 substantially level with the deck 130, the top of the lid 105 may be flush with the deck 130 and reduce the risk of tripping on the housing 100 and also contribute to the overall aesthetic appeal of the housing-lid configuration.

Figure 1D:
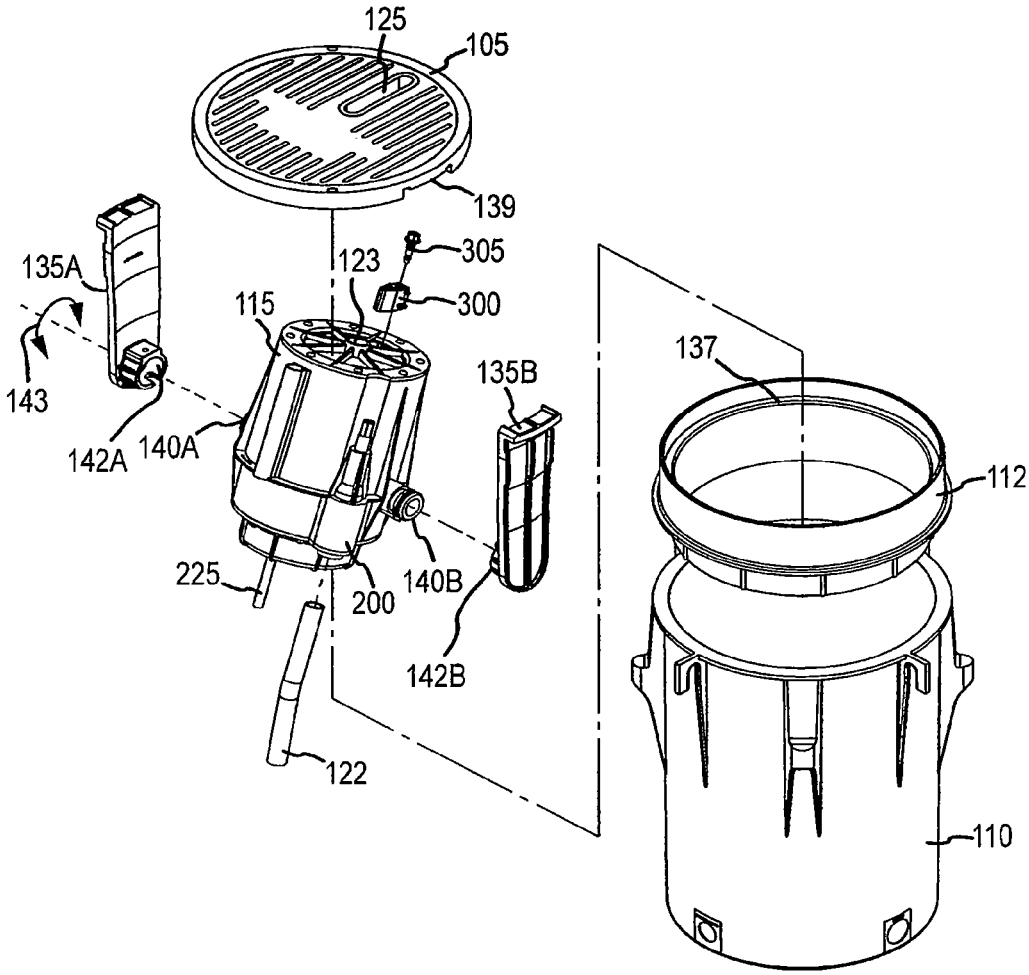
FIG. 1D illustrates an exploded view of the exemplary water handling device and the housing of FIG. 1B.
Figure 1E:
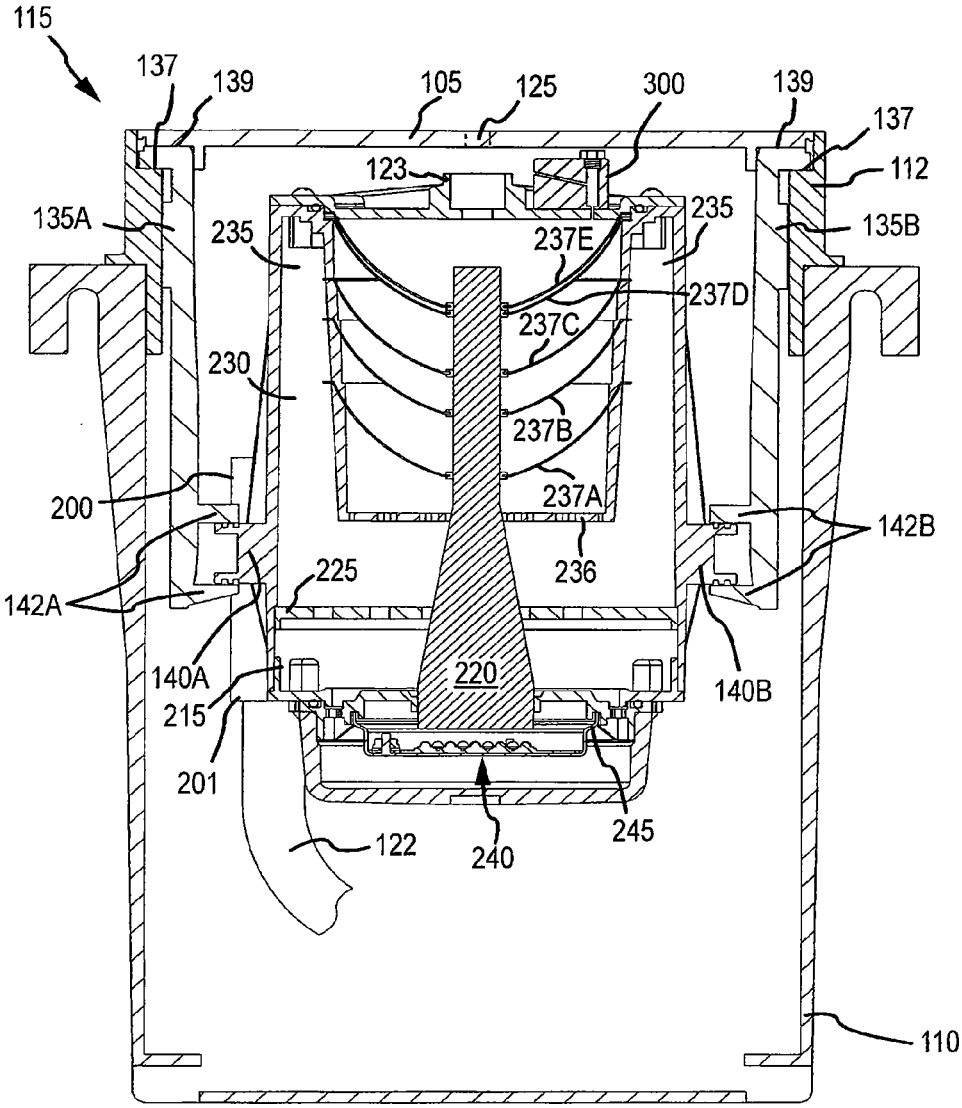
FIG. 1E illustrates a cross-sectional view of the exemplary water handling device of FIG. 1B within the housing.

FIG. 1D illustrates an exploded view of the laminar jet 115 and the housing 100. FIG. 1E illustrates a cross section of the laminar jet 115 within the housing 100. Referring to FIGS. 1D and 1E in conjunction with FIG. 1B, the laminar jet 115 may be situated within the housing 100 and hang from the collar 112 using two or more adjustable hanging brackets 135A-B. In some embodiments, the collar 112 and the adjustable brackets 135A-B may be a single unitary piece such that only a single bracket may be used. The brackets 135A-B may seat on an inner lip 137 of the collar 112 such that the laminar jet 115 may swivel about the collar 112 as indicated by the double sided arrow 138 in FIG. 1B. This may allow a wide variety of trajectories in the body of water 120.

To accommodate the brackets 135A-B, and to allow the laminar jet 115 to sit flush to the top of the collar 112, the lid 105 may include a plurality of recesses 139 situated about the surface of the lid 115 that engage the collar 112. Suspending the laminar jet 115 from the collar 112, instead of from the lid 105, may allow the laminar jet 115 to be more modular, which may allow for ease of installation and adjustment. For example, if the laminar jet 115 were hung from the lid 105, the cumbersome combined lid-jet structure would have to be removed and then the laminar jet 115 may need to be unfastened from the lid 105 in order to adjust the laminar jet 115.

As shown in FIGS. 1D and 1E, the brackets 135A-B may couple to the laminar jet 115 using a series of stubs 140A-B that rotatably seat within respective cavities 142A-B. Some embodiments may secure the stubs 140A-B to the cavities 142A-B using a press fit connection. Other embodiments may implement the stubs 140A-B in a threaded fashion such that the stubs 140A-B screw into the cavities 142A-B. In this manner, the laminar jet 115 may be centered within the housing 100 by threading and/or unthreading the stubs 140A-B into and/or out of the cavities 142A-B. During operation, the stubs 140A-B may rotate within the cavities 142A-B allowing the laminar jet 115 to move in the direction shown by the double sided arrow 143 in FIG. 1D. Moving the laminar jet 115 in this fashion may allow fluid exiting the laminar jet 115 via the orifice 123 to accomplish the varying trajectories shown in FIG. 1C.

Figure 1F:
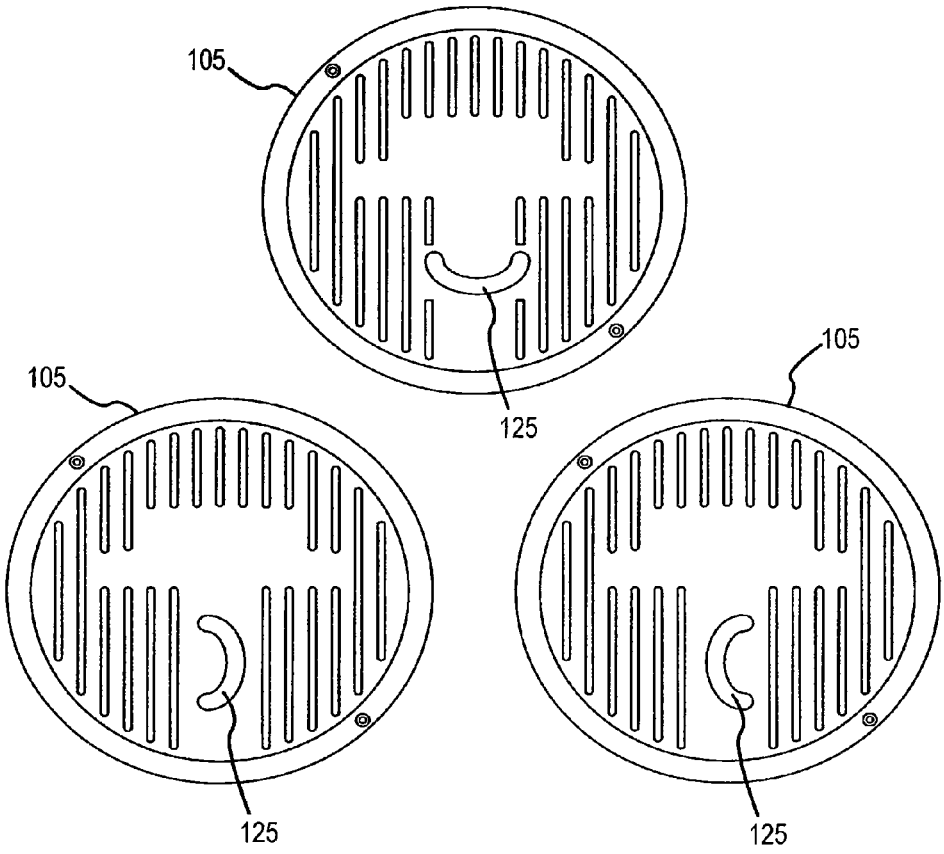
FIG. 1F illustrates alternate lid configurations of the housing of FIG. 1A.

The opening 125 in the lid 105 also may be configured to allow for varying trajectories. For example, the opening 125 may be an elongated loop as shown in FIGS. 1A, 1B, and 1D. Other embodiments, such as those shown in FIG. 1F, may include arcuate openings 125 having a curved path with respect to the surface of the lid 105 such that the water from the orifice 123 may be adjusted along this curved path by adjusting the laminar jet 115 within the housing 110.

Figure 2A:
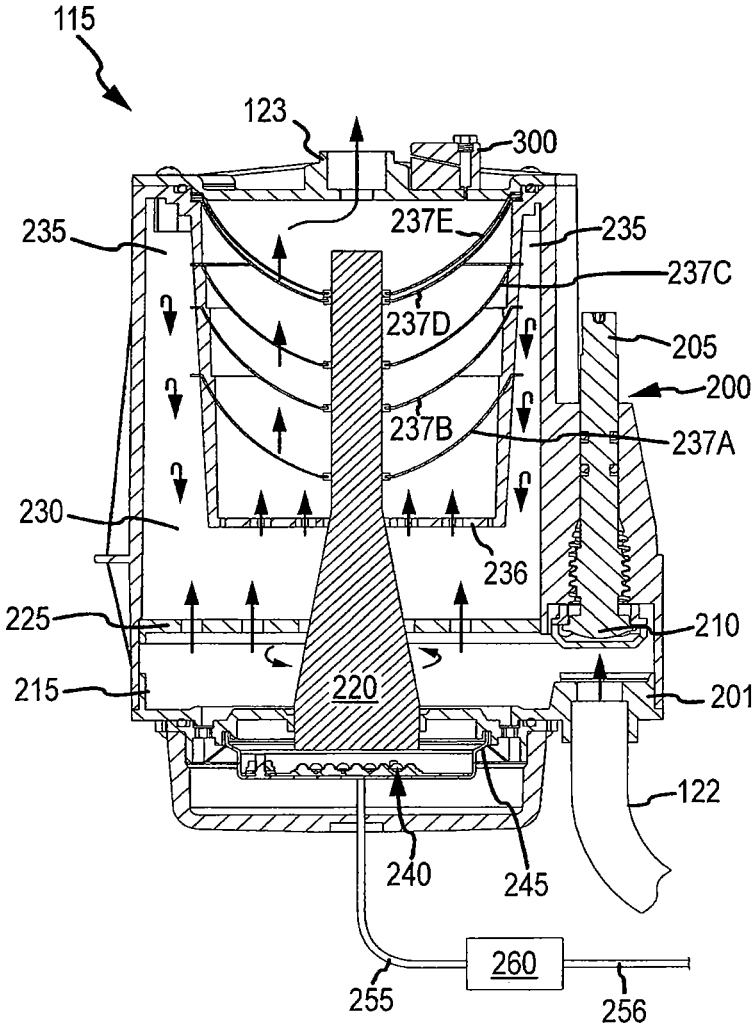
FIG. 2A illustrates a cross-sectional view of an exemplary water handling device.
Figure 2B:
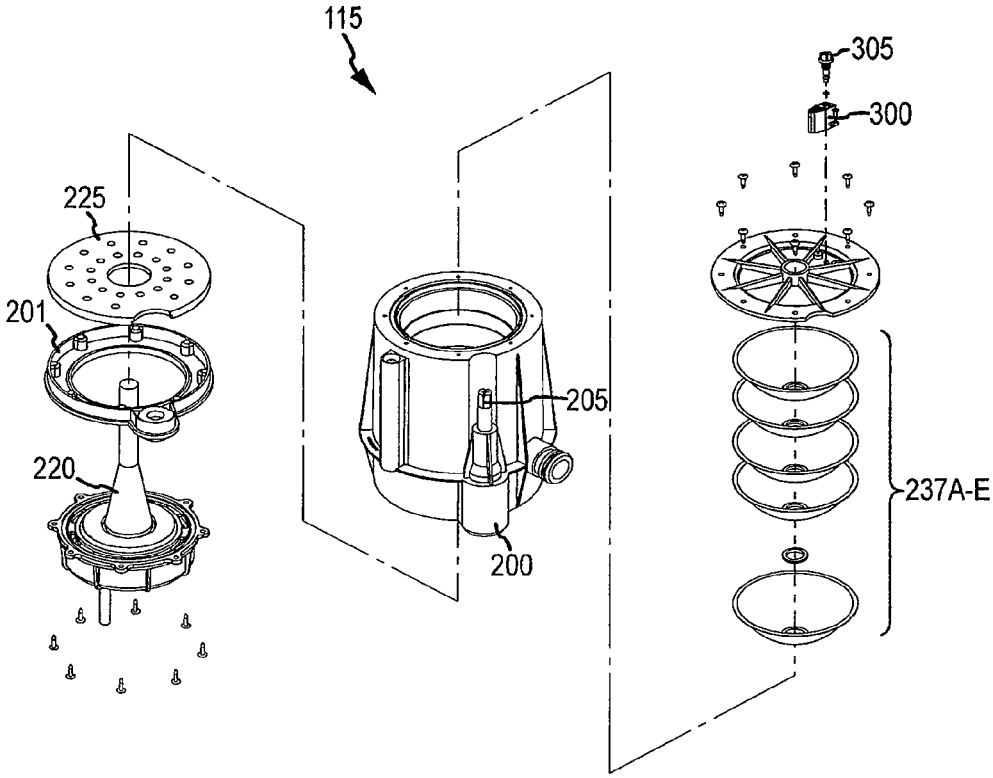
FIG. 2B illustrates an exploded view of the exemplary water handling device of FIG. 1A.

FIG. 2A illustrates a cross-sectional view of an exemplary implementation of the laminar jet 115. FIG. 2B illustrates an exploded view of the exemplary implementation of the laminar jet 115 of FIG. 2A. Referring to FIGS. 2A-B, the laminar jet 115 may include a flow adjustment valve 200 coupled to a lower bracket 201 of the laminar jet's 115 housing. The embodiment shown in FIGS. 2A-B utilizes a screw 205 that may be rotated clockwise and/or counter clockwise to control the overall volumetric flow rate of fluid entering the bracket 201, and thereby also may control the overall volumetric flow rate of fluid through the laminar jet 115. As shown by the directional arrows in FIG. 2A, during operation, water entering the bracket 201 may flow past a piston 210 coupled to the screw 205. In this manner, as the screw 205 is rotated, the overall flow rate through the laminar jet 115 may be varied. For example, FIG. 2C shows the piston 210 fully seated against the supply line 122 such that fluid does not enter the laminar jet 115.

Figure 2C:
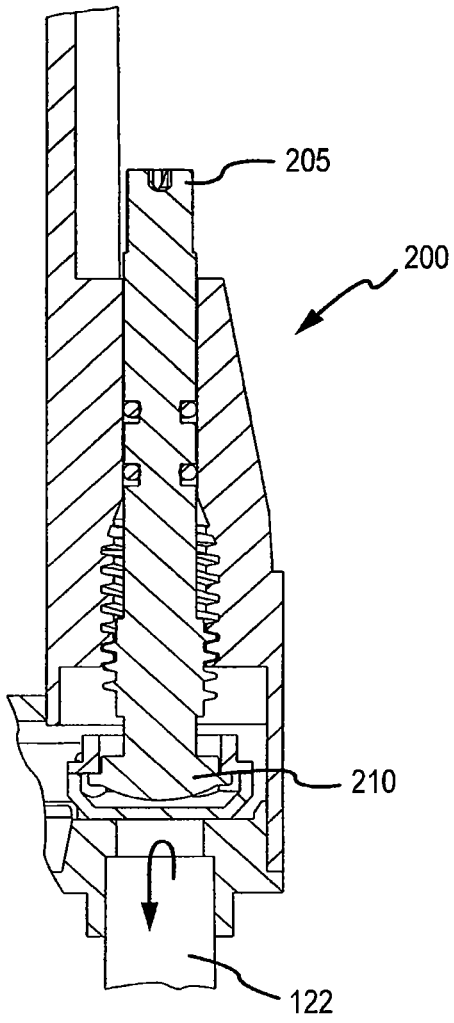
FIG. 2C illustrates a cross-sectional view of an exemplary valve in the closed position of the water handling device of FIG. 1A.
Figure 2D:
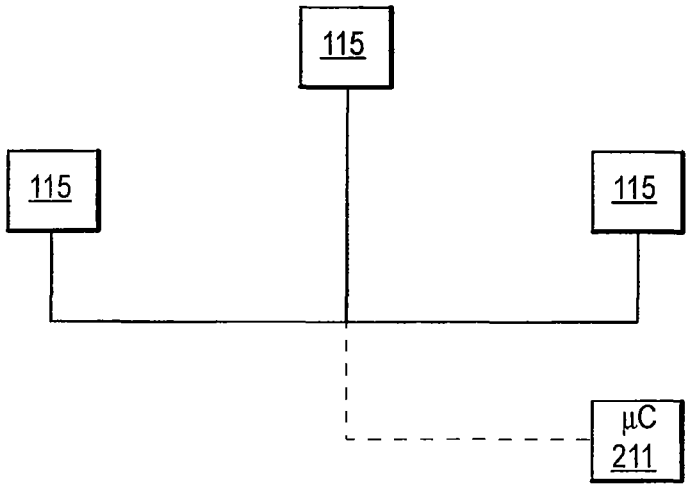
FIG. 2D illustrates a block diagram of an exemplary control network of water handling devices.

Although the embodiment shown in FIGS. 2A-2C illustrates the use of a screw 205 for adjustment of the valve 200, it should be appreciated that many alternate arrangements are possible. For example, the valve 200 may employ a hand actuated controller, such as a thumbscrew or T-handled valve, to adjust the flow rate. Still other embodiments may utilize an electrically controlled servo, solenoid, stepper motor, and/or worm gear to adjust the flow rate. This adjustment may be controlled individually or in a networked fashion using a logic controller 211 as shown in FIG. 2D. For example, the logic controller 211 may couple to a plurality of servos on the laminar jets 115 to synchronize their flow operations with each other. In some embodiments, the logic controller 211 may be implemented using a microcontroller, such as the PIC32™ from Microchip.

When the laminar jet 115 is positioned within the housing 100, as shown in FIGS. 1B and 1C, the volumetric flow rate may be adjusted by turning the screw 205. This may allow a user to adjust the flow rate of the laminar jet 115 without having to remove it from the housing 100. In fact, in some embodiments, the lid 105 may include an opening (not shown) that aligns with the screw 205 so that the screw 205 may be adjusted without removing the lid 105. Adjusting the flow rate in conjunction with adjusting the angle of the laminar jet 115 with respect to the housing may allow various trajectories.

Water flow through the laminar jet 115 may follow a path illustrated by the arrows in FIG. 2A. Referring to FIG. 2B in conjunction with the arrows shown in FIG. 2A, water may flow into a receiving chamber 215 where it may circulate about a light tube 220 (described in further detail below). Pressure from the supply line 122 may force the water from the receiving chamber through a baffle 225 into an intermediate chamber 230. In general, turbulent flow may exist when streamlines of the fluid intersect and cross each other creating a mixture of fluid in the flow path. As water passes through the baffle 225 the turbulence of the flow path may be reduced. Water exiting the baffle 225 may circulate within the intermediate chamber 230. The intermediate chamber 230 may contain an annular cavity 235 that surrounds the laminar jet 115 such that water entering the intermediate chamber 230 may travel within the annular cavity 235 before exiting the intermediate chamber 230. The water's turbulence also may be reduced by traveling through the annular cavity 235 prior to exiting the intermediate chamber 230. As shown in the embodiment depicted in FIG. 2A, the annular cavity 235 may be manufactured as a rigid plastic structure.

Water may exit the intermediate chamber 230 and pass through a second baffle 236 further calming the flow, and then through a plurality of conically shaped mesh filters 237A-E. As water flows through each successive stage of the filters 237A-E, the laminarity of the water flow may be improved until the water flow exiting the laminar jet 115 is substantially laminar in form, i.e., streamlines of fluid are substantially parallel. In this manner, the water exiting the laminar jet 115 may produce a laminar arc of water into the body of water. These laminar arcs of water may be used in a variety of settings for decorative purposes, such as decorative water fountains and/or light displays around bodies of water.

Each of the filters 237A-E may include an opening for the light tube 220 to pass through. Some embodiments may use a fiber optic material for the light tube 220. In other embodiments, the light tube 220 may be a clear or colored plastic or other suitable material.

As shown in FIG. 2A, the light tube 220 may couple to a plurality of lights 240. During operation, the light tube 220 may impart photon energy it receives from the lights 240 onto the laminar water flow exiting the orifice 123. Exemplary implementations of the lights 240 may include halogen, incandescent, digital light processing (DLP), and LEDs to name but a few. In the embodiments utilizing LEDs, the laminar jet's 115 housing may be smaller than other lighting types. Also, since the LEDs may be implemented as an array as shown, implementing the lights 240 using LEDs may add a level of redundancy such that if one of the LEDs fails, the other LEDs in the array may compensate. This may reduce the overall maintenance of the laminar jet 115. Furthermore, implementing the lights 240 as an array of LEDs may allow different colors of lights to be turned on independent of each other. For example, the lights 240 may include red, green, and blue LEDs where the water flowing out the laminar jet 115 may be made any variety of colors by selectively combining these primary colors.

Figure 2E:
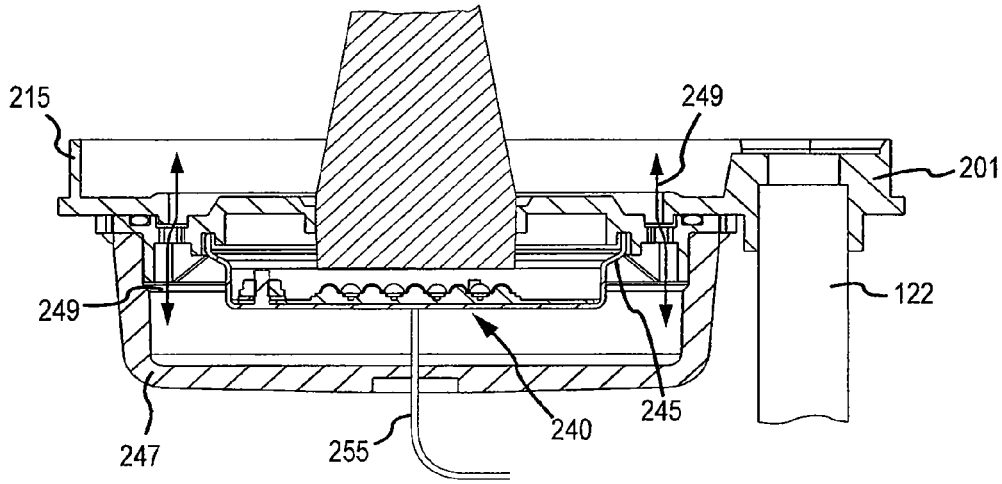
FIG. 2E illustrates a cross-sectional view of an exemplary light configuration of the water handling device of FIG. 1A.

FIG. 2E illustrates an enlarged view of the lights 240 situated within the bottom of the laminar jet 115. The lights 240 may reside in a sealed canister 245 that is thermally coupled to the water flowing in the laminar jet 115. Water in the receiving chamber 215 may enter and/or exit a bottom chamber 247 of the laminar jet 115 through a series of slots 249 as shown by the arrows in FIG. 2E. Once in the bottom chamber 247, the water may immerse the canister 245 to cool the lights 240. Because the canister 245 is sealed, water flowing through the laminar jet 115 may be prevented from entering the canister 245 and damaging the lights 240. Some embodiments may implement the canister 245 using thermally conductive metal, such as stainless steel in compliance with the Underwriters Laboratories 676 standard for underwater luminaries and submersible junction boxes. In this manner, the water immersing the canister may cool the lights 240 and reduce the level of thermal stress on the lights 240. The lights 240 may receive their electrical power and/or electrical control signals via an electrical supply line 255. For example, in the embodiments where the lights 240 include multiple colors of lights, the control wires may control which of various colors are lit at different points in time.

Referring back to FIG. 2A, in some embodiments, a main electrical line 256 capable of carrying standard electrical power (e.g., 120 VAC, 60 Hz) may be coupled to a controller 260 located in the housing 100. The controller 260 may be capable of converting the power received from the main electrical line 256 down to a suitable voltage and/or suitable current for the lights 240 and providing it to the laminar jet's 115 electrical supply line 255. Additionally, the controller 260 may be capable of providing one or more electrical control signals to the lights 240 based upon whether an electrical signal is present on the main electrical line 256. For example, as shown in FIG. 1C, there may be multiple laminar jets 115, where the laminar jets 115 are coupled together via the main electrical supply line 256. In some embodiments, the laminar jets 115 may be synchronized via the electrical supply line 256 by switching the electrical power on the supply line 255 on and off using a switch 265. For example, as a user toggles the switch 265 on and off a predetermined number of times, the laminar jets 115 may initialize, and as the switch 265 is further toggled, the laminar jets 115 may be programmed to achieve a predetermined light color or color pattern. In some embodiments, the changes in lighting may be synchronized to music. Furthermore, in some embodiments, the switch 265 may control the flow adjustment valve 200 or a surface disruptor 300 (described in detail below) along with the light color and/or music. This control may be random in some embodiments, or a predetermined pattern in other embodiments.

Light may be coupled from the light tube 220 into the fluid flow prior to exiting the orifice 123. As mentioned previously, the water flow from the laminar jet 115 may be substantially laminar as it exits the orifice 123, and therefore, it may have a smooth, glass, rod-like outer surface. Because of this glass, rod-like outer surface, light coupled into the water may be carried by the exiting water with minimal angular scatter. That is, the water flow may be conducted like a fiber optic light tube such that bends in the water flow path may reflect the light internally, making the light more prominent at the bends, whereas the straight portions of the water flow path may have a transparent appearance. Since the water flow from the laminar jet 115 may have a transparent appearance in some sections, the laminar jet 115 may include a surface disruptor 300 as shown in FIGS. 3A-3E and 5A-6C.

Figure 3A:
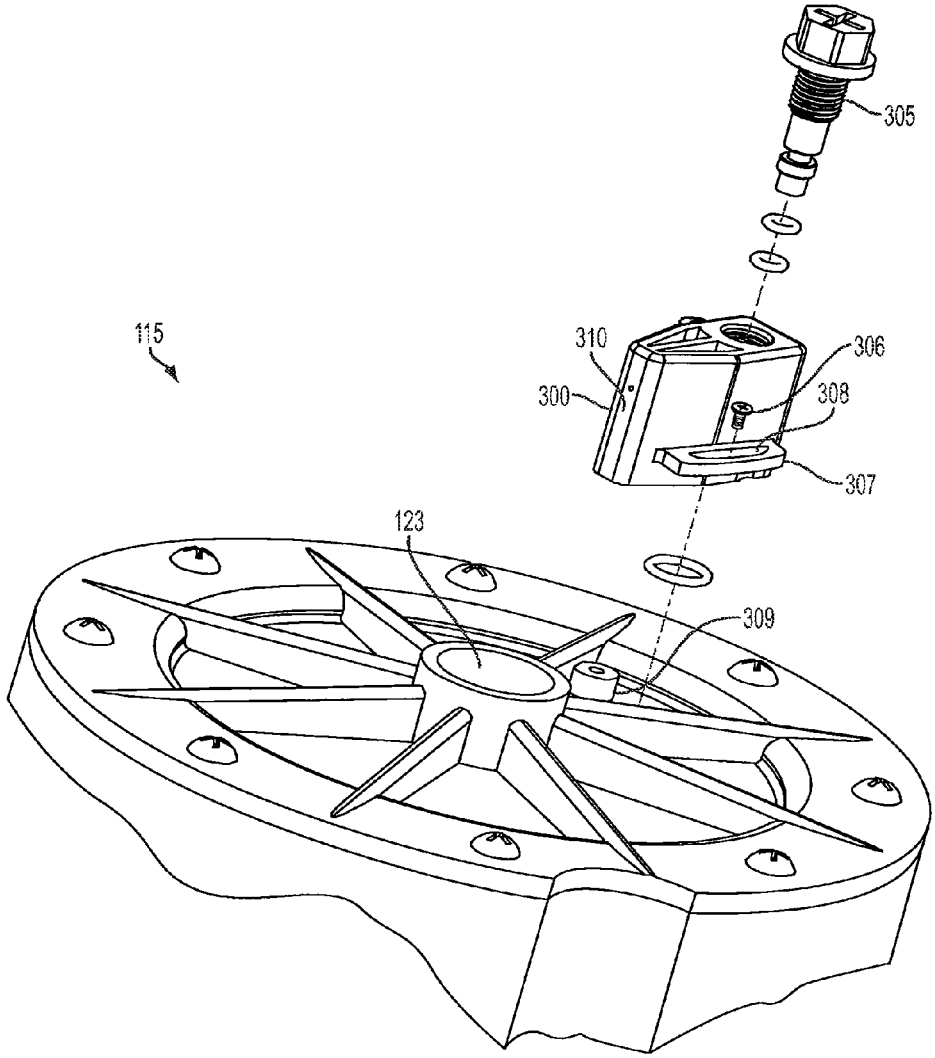
FIG. 3A illustrates an exploded view of an exemplary surface disruptor.

Referring to FIG. 3A, the surface disruptor 300 may couple to the laminar jet 115 near the orifice 123. In some embodiments, the disruptor 300 may be coupled to the laminar jet 115 using a screw 306, while in other embodiments, the disruptor 300 may include one or more tabs (not shown) that press fit into the laminar jet 115 to secure the disruptor 300 to the laminar jet 115. During operation, the surface disruptor 300 may perturb the surface of the laminar flow of water exiting the orifice 123. By disrupting the surface of the laminar flow, light transmission from the surface of the water flow may be enhanced by refraction of the light. In other words, light in the water flow may be more noticeable because the glass rod-like appearance of the surface of the laminar flow may have deliberate imperfections introduced. Some embodiments may modify the surface of the laminar flow by diverting at least a portion of water from the water circulating in the laminar jet 115 into the water exiting the orifice 123. For example, as shown in FIG. 3B, the disruptor 300 may include an orifice 310 that emits a stream 315 of water from the laminar jet 115 in such a way that that the trajectory of the water emitted from the orifice 310 intersects with a laminar flow 320 coming from the orifice 123.

Figure 3B:
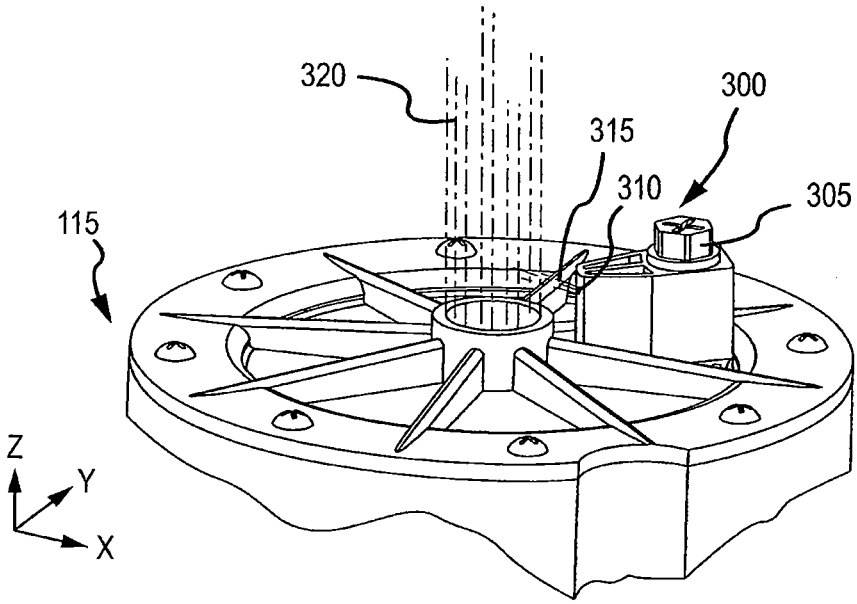
FIG. 3B illustrates the surface disruptor of FIG. 3A during exemplary operations.
Figure 3C:
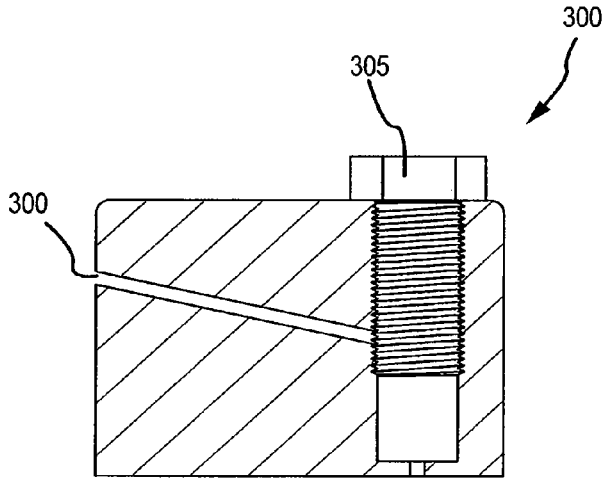
FIG. 3C illustrates a schematic cross-sectional view of an exemplary surface disruptor.

FIG. 3C illustrates a cross section of the disruptor 300. As a screw valve 305 threads in and out of the disruptor 300, the flow rate of the stream 315 exiting the orifice 310 may vary. Adjusting the flow rate of the stream 315 in this manner may modify the laminarity of the laminar flow 320, and therefore, the appearance of light conducted therein and refracted therefrom. FIGS. 3A and 3B illustrate embodiments where the adjustment mechanism for the flow rate of the stream 315 is a screw that may be adjusted with a screwdriver. In these embodiments, the lid 105 of the housing 100 may include an opening (not shown) to insert a screwdriver so that the lid 105 does not need to be removed to adjust the flow rate and/or appearance of the lighting in the laminar flow 320. Other embodiments may include hand actuated valves, such as thumbscrews or a T-valve. Still other embodiments may utilize an electrical servo to adjust the flow rate of the stream 315. These adjustment mechanisms may be controlled by the logic controller 211 shown in FIG. 2D.

The angular intersection of the stream 315 and the laminar flow 320 shown in FIG. 3B may be adjusted to modify the lighting effects and/or trajectories of the laminar flow 320. For example, the disruptor 300 may be attached to the top of the laminar jet 115 by a screw 306 secured through an opening in a fastening tab 307. The fastening tabs 307 may include one or more channels such that as the screw is loosened from a fastening post 309 in the top of the laminar jet 115, the disruptor 300 may pivot angularly. (Although not specifically shown in FIG. 3A, the reverse side of the disruptor 300 may include a similar screw, fastening tab, and channel arrangement.) As the disruptor 300 pivots about the stationary fastening post 309, the disruptor 300 may be adjusted in the plane defined by the surface of the laminar jet 115 such that the angular intersection of the stream 315 and the laminar flow 320 changes as the screw 306 moves within the channel 308. In other embodiments, the top of the laminar jet 115 may include a swivel-mounted receiver for the disruptor 300 such that the disruptor 300 may swivel about the plane defined by the top of the laminar jet 115.

Figure 3D:
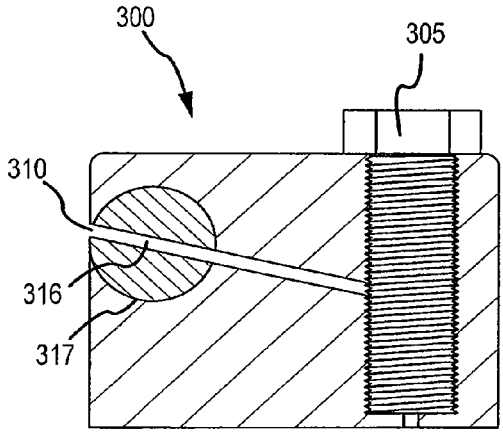
FIG. 3D illustrates a schematic cross-sectional view of an exemplary adjustment mechanism for the surface disruptor.
Figure 3E:
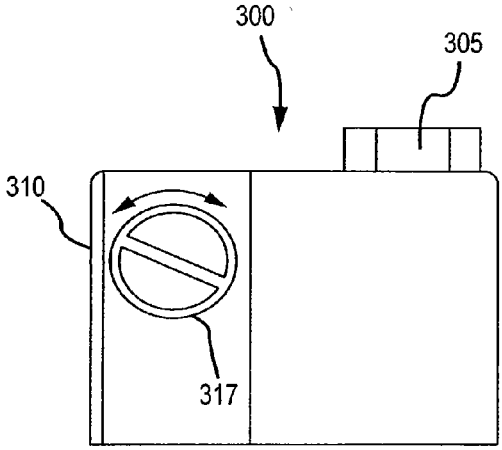
FIG. 3E illustrates a side view of an exemplary adjustment mechanism for the surface disruptor.

Also, as shown in the isometric and cross-sectional views in FIGS. 3D and 3E, in some embodiments, the disruptor 300 may include a flexible exit tube 316 that may be adjusted to adjust the trajectory of the stream 315. As shown, the exit tube 316 may be coupled to a hand actuated trajectory adjuster 317. Rotating this valve may adjust the angular intersection of the stream 315 and the laminar flow 320. While the trajectory adjuster 317 is shown as hand actuated, it should be appreciated that other embodiments may include a variety of hand actuated valves, such as thumbscrews or a T-valve. Still other embodiments may utilize an electrical servo to adjust the angle of the stream 315. These adjustment mechanisms may be controlled by the logic controller 211 shown in FIG. 2D.

In some embodiments, the flow rate of the stream 315 may be adjusted in conjunction with the flow rate of the laminar flow 320. For example, the screw valve 305 and the valve 200 may be adjusted together with the trajectory adjuster 317 until a desired appearance for the laminar flow 320 is achieved.

Figure 3F:
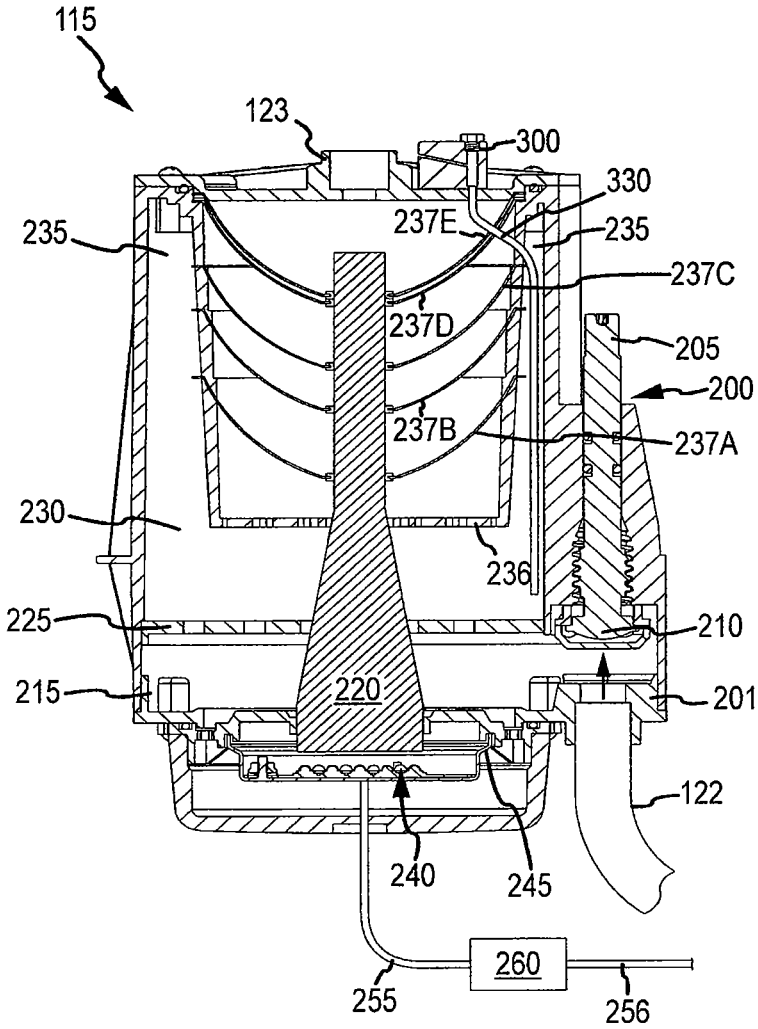
FIG. 3F illustrates a schematic cross-sectional view of one embodiment of a fluid handling device for supplying the surface disruptor with water.
Figure 3G:
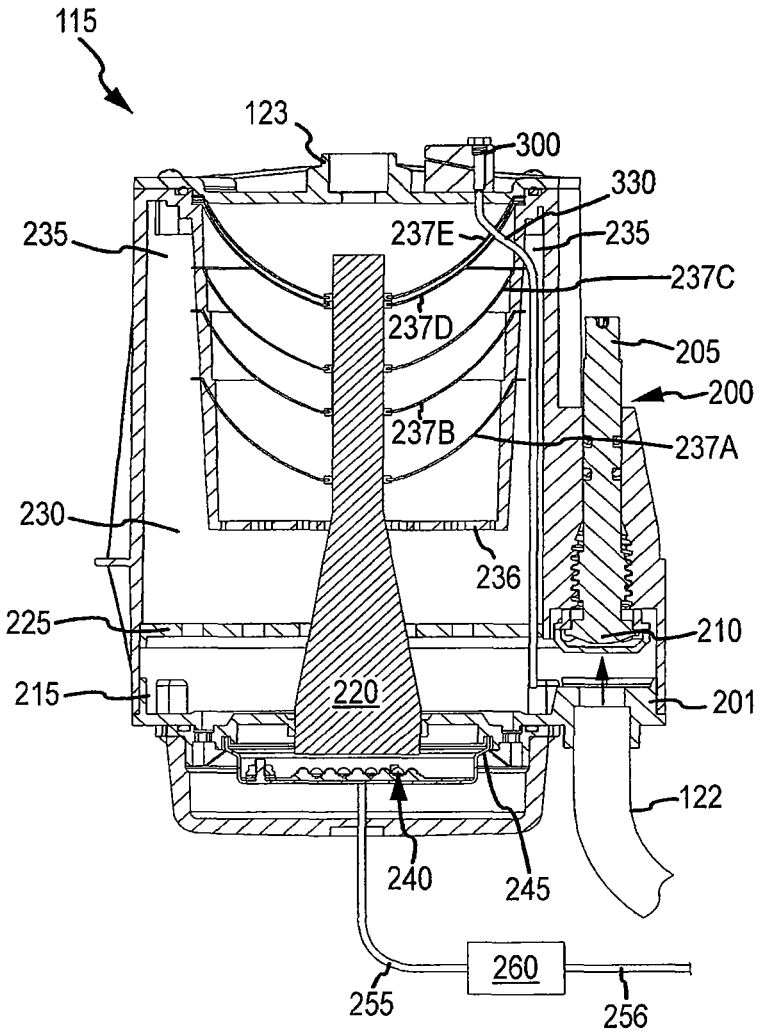
FIG. 3G illustrates a cross-sectional view of yet another embodiment of a fluid handling device for supplying the surface disruptor with water.
Figure 3H:
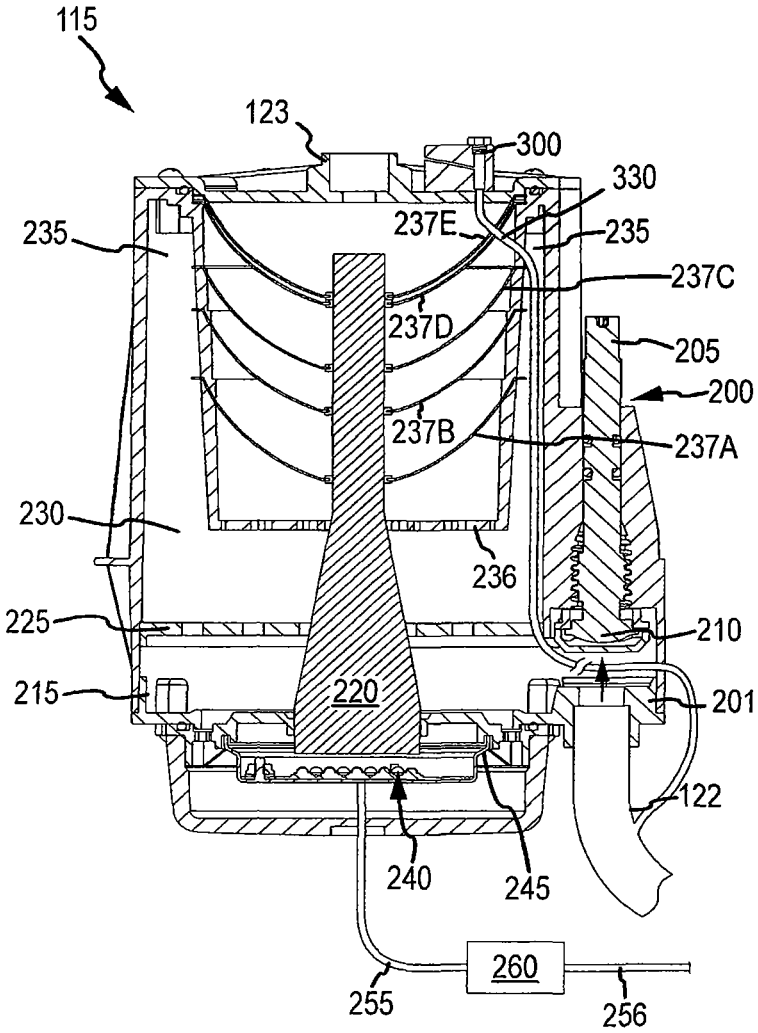
FIG. 3H illustrates a cross-sectional view of still another embodiment of a fluid handling device for supplying the surface disruptor with water.

Although FIGS. 1D, 2A, and 3A-B illustrate an embodiment where the surface disruptor 300 draws water from the top of the laminar jet 115, water may be drawn from other locations. As described above, the water in the top of the laminar jet 115 may be substantially laminar. By drawing water from other locations, the laminarity of the stream 315 may be varied and, as a result, the effect on the laminar flow 320 may vary. For example, water drawn from the receiving chamber 215 via a tube 330 may be more turbulent than water drawn from the intermediate chamber 230 and drawing water from the two locations (as shown in FIGS. 3 3F and 3G respectively) may result in varying degrees of illumination in the laminar flow 320. Other embodiments may modify the surface of the laminar flow exiting the orifice 123 using a stream of water that is separate from the laminar jet 115. For example, FIG. 3H illustrates an embodiment in which water from the supply line 122 may be used to disrupt the surface of the laminar flow exiting the orifice 123. Furthermore, since the water within the top of the laminar jet 115 is substantially laminar, drawing water from this chamber may impact the overall laminarity of the laminar flow 320. Thus, an additional benefit of drawing water from a location other than the top of the laminar jet 115 is that the laminarity of the water within the laminar jet 115 may be preserved.

Figure 4:
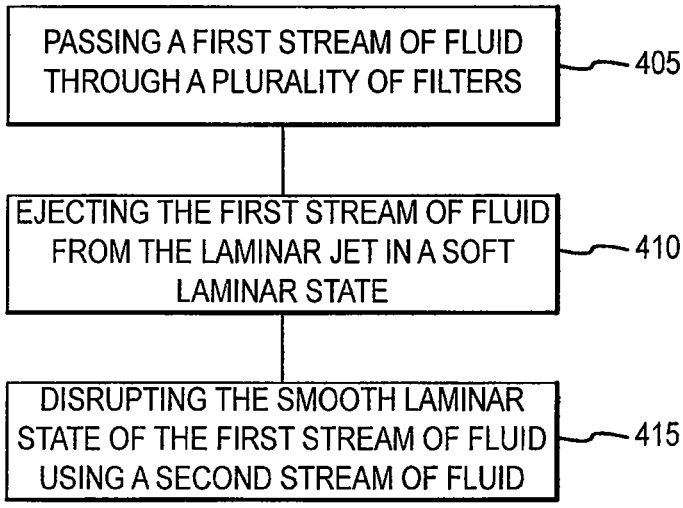
FIG. 4 is a flow diagram illustrating exemplary operations that may be performed by the exemplary water handling device.

The laminar jet 115 may operate according to the operations shown in FIG. 4. In block 405, the laminar jet 115 may pass the stream of fluid from the supply line 122 through a series of filters 237A-E. Passing the stream of fluid through this series of filters in this manner may result in flow that is substantially laminar in nature, and this laminar flow may be ejected from the laminar jet 115 per block 410. Next, in block 415, the surface disruptor 300 may disrupt the substantially laminar flow exiting via the orifice 123. As mentioned above in the context of FIGS. 3F-3H the fluid used by the surface disruptor 300 may come from a variety of locations within the laminar jet 115.

Figure 5A:
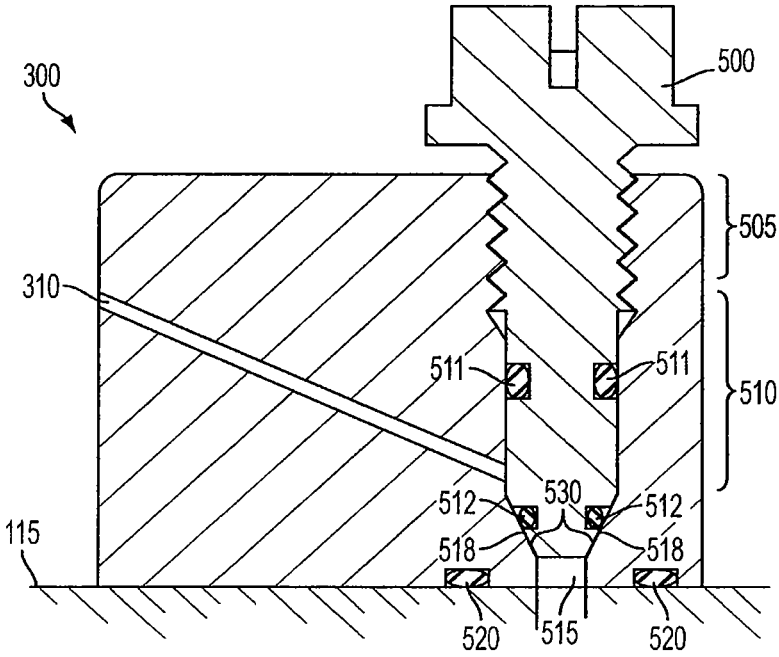
FIG. 5A illustrates a cross-sectional view of an exemplary surface disruptor.

FIGS. 5A-6D illustrate various embodiments of a disruptor 300 in greater detail. Referring initially to FIG. 5A, the disruptor 300 may include a screw valve 500 that is threaded in and out of a generally tubular channel 317 formed in the disruptor 300. In some embodiments, both the screw valve 500 and the disruptor 300 may be manufactured using injection molded plastic parts. Manufacturing the disruptor 300 and screw valve 500 in this manner may produce a more cost effective method of manufacturing than conventional approaches, such as manufacturing the disruptor 300 and the screw valve 500 using stainless steel. As shown, the screw valve 500 may include an upper threaded portion 505 and a lower non-threaded portion 510. The threaded portion 505 interfaces with corresponding threading 509 in an upper portion of the tubular channel 517. The non-threaded portion 510 may include one or more O-rings 511 and 512. The threaded portion 505 allows the screw valve 500 to be secured and adjusted within the disruptor 300 while the non-threaded portion 510 assists in directing fluid through the tubular channel 517 in the desired direction at the desired time. The non-threaded portion 510 of the screw valve 500 may be tapered to form a frustum 530. The lower portion of the tubular channel 517 also may be tapered and form tapered walls 518 to receive and interface with the frustum 530. As shown in FIG. 5A, one of the O-rings 512 may be positioned with an annular channel 519 formed in the frustum 530.

Fluid may enter the disruptor 300 from the laminar jet 115 through an orifice 515. An O-ring 520 may be positioned between the laminar jet 115 and the disruptor 300 so as to prevent fluid from leaking from between the interface of the disruptor 300 and the laminar jet 115. FIG. 5A illustrates the screw valve 500 in a closed position and, as such, fluid entering into the orifice 515 may be prevented from exiting the disruptor 300 because the O-ring 512 may be seated against tapered walls 518 of a lower portion of the tubular channel 517.

Figure 5B:
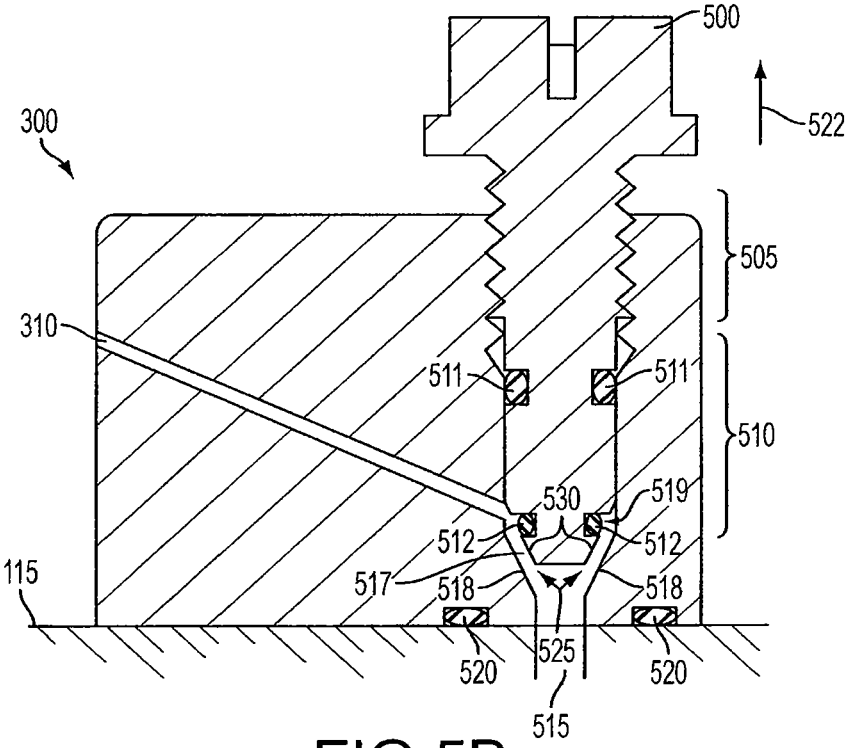
FIG. 5B illustrates a cross-sectional view of the exemplary surface disruptor of FIG. 5A in the open position.

FIG. 5B illustrates the screw valve 500 being slightly unthreaded from the tubular channel 517 in the direction of arrow 522. In this arrangement, fluid entering the orifice 515 may travel through a passage 525 created between a frustum 530 and the tapered walls 518 of the tubular channel 517. As the screw valve 500 is backed out (in the direction of the arrow 522) the O-ring 512 no longer makes contact with the tapered walls 518 and fluid may flow through the passage 525 between the tubular channel 517 and the screw valve 500 and out the orifice 310. Note that despite the screw valve 500 being slightly unthreaded, the top O-ring 511 may maintain contact with the walls of the tubular channel 517 so as to seal off fluid exiting the disruptor 300 through the threaded portion 505. Thus, as the screw valve 500 is unthreaded from the tubular channel 517 (in the direction of the arrow 522), the size of the passage 525 may increase, and as a result, the volumetric flow and force of the fluid stream out of the orifice 310 may increase. Similarly, as the screw valve 500 is threaded into the tubular channel 317 (in the opposite direction of the arrow 522), the size of the passage 525 may decrease and, as a result, the volumetric flow out of the orifice 310 and also the force of the fluid stream may decrease.

Figure 5C:
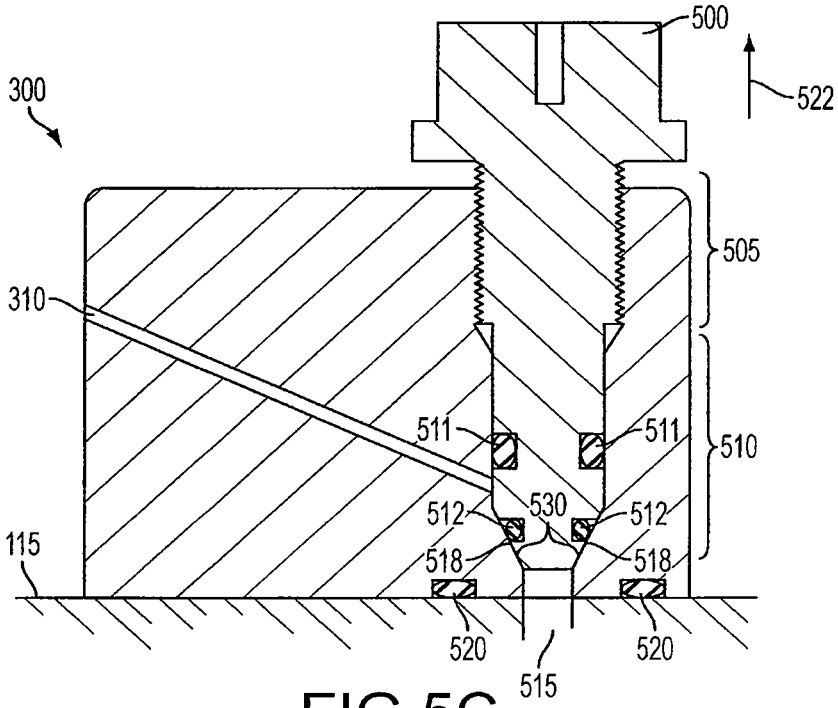
FIG. 5C illustrates a cross-sectional view of another exemplary embodiment of a surface disruptor in which the valve has a narrower thread pitch.
Figure 5D:
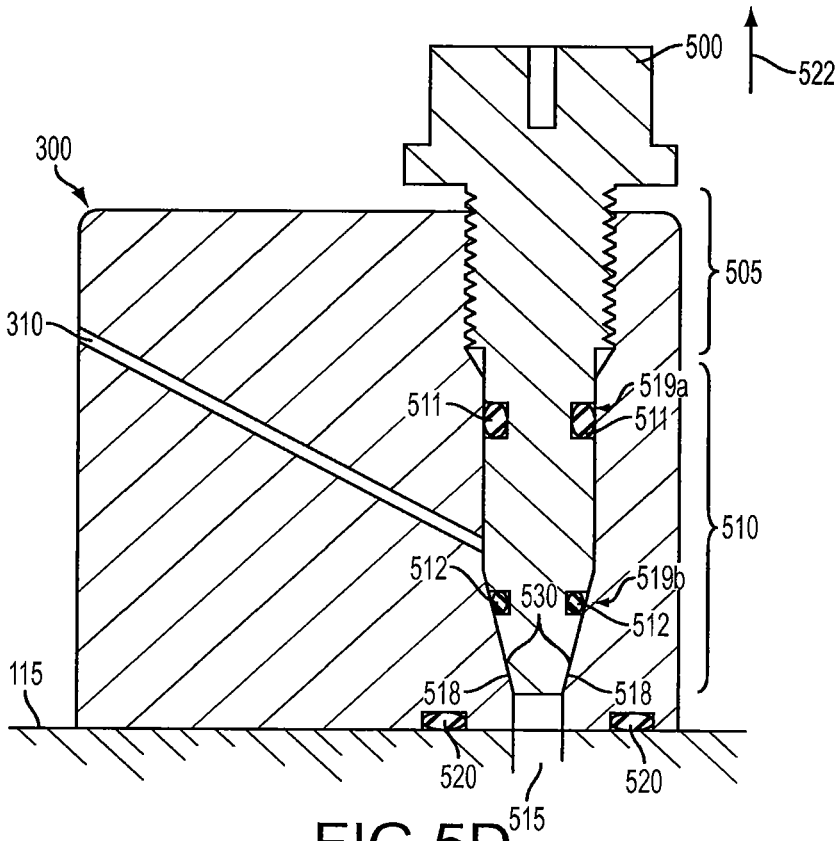
FIG. 5D illustrates a cross-sectional view of a further exemplary embodiment of a surface disruptor having a valve with a steep taper along a closure surface.
Figure 5E:
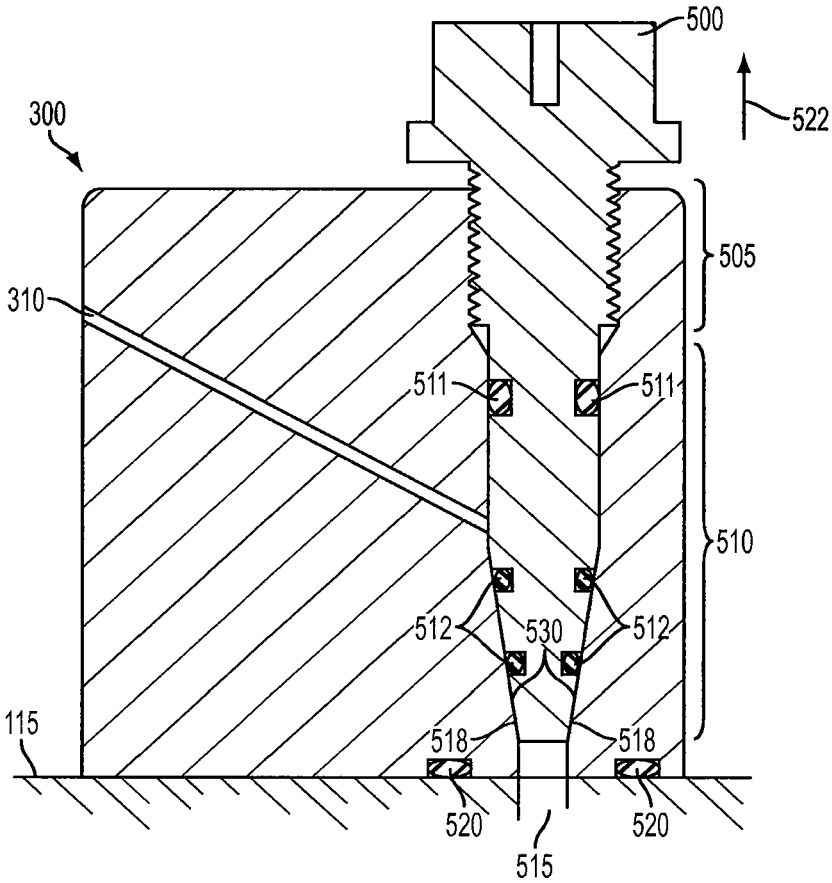
FIG. 5E illustrates a cross-sectional view of yet another exemplary surface disruptor having a steep tapered slope and multiple seals on the valve.

The configuration of the threaded portion 505 and the non-threaded portion 510 may vary between different embodiments as shown in FIGS. 5C-5E. For example, FIG. 5C illustrates the screw valve 500 where the threaded portion 505 has a narrower thread pitch than what is shown in FIGS. 5A and 5B. By implementing the screw valve 500 with a narrower thread pitch the passage 525 may be more finely adjusted as the screw valve 500 rotates and, as a result, the overall volumetric flow rate of the disruptor 300 may be more finely adjusted.

As another example, FIG. 5D illustrates the screw valve 500 where the non-threaded portion 510 includes a steeper frustum 530 than what is shown in FIGS. 5A and 5B. Because the frustum 530 is steeper, the passage 525 defined as the screw valve 500 is removed from the tubular channel 317 may be longer and thinner than what is shown in FIGS. 5A and 5B and, therefore, different volumetric flow rates and fluid pressures may be defined for similar thread positioning. FIG. 5E illustrates the screw valve 500 with an even steeper frustum 530 than what is shown in FIG. 5D and where the frustum 530 defines two annular channels 519*a*, 519*b* for seating two O-rings 512 and 513. In this embodiment, the positioning of the O-rings 512 and 513 as well as the increased angle of the frustum 530 may allow more precise control over the size of the passage 525 and, as a result, may allow more precise control over the volumetric flow rate and force of the fluid stream emanating from the disruptor 300.

Figure 6A:
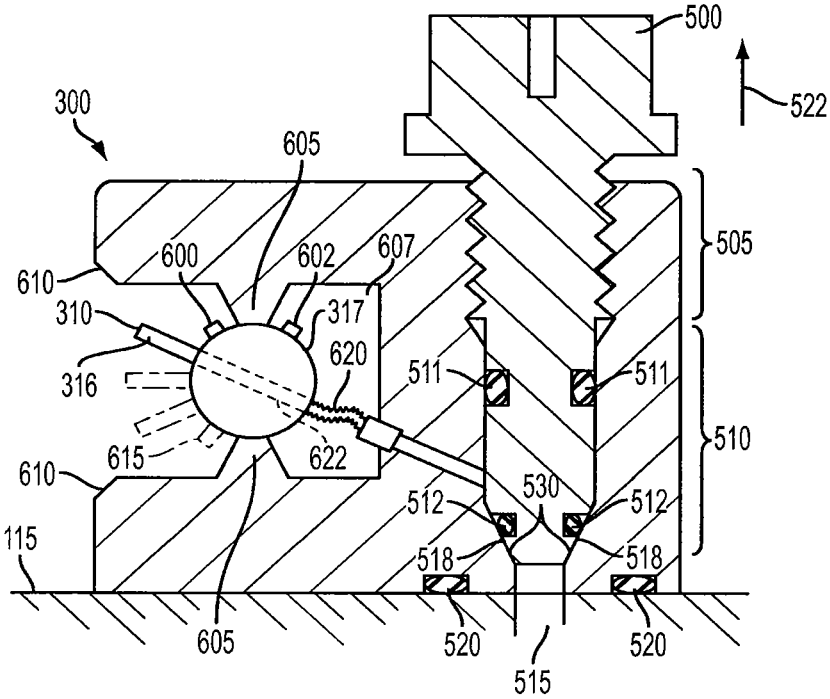
FIG. 6A illustrates a cross-sectional view of an exemplary surface disruptor with a trajectory adjustment mechanism.
Figure 6B:
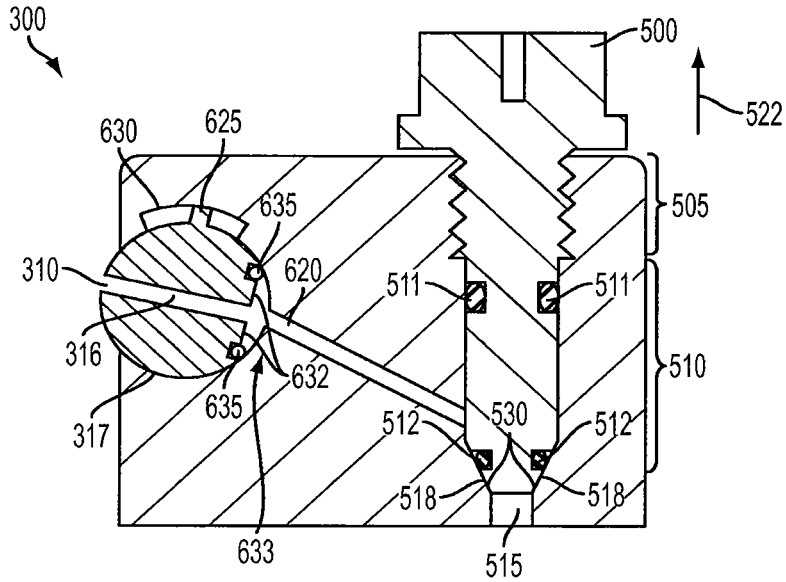
FIG. 6B illustrates a cross-sectional view of another exemplary surface disruptor with an alternate embodiment of a trajectory adjustment mechanism.
Figure 6C:
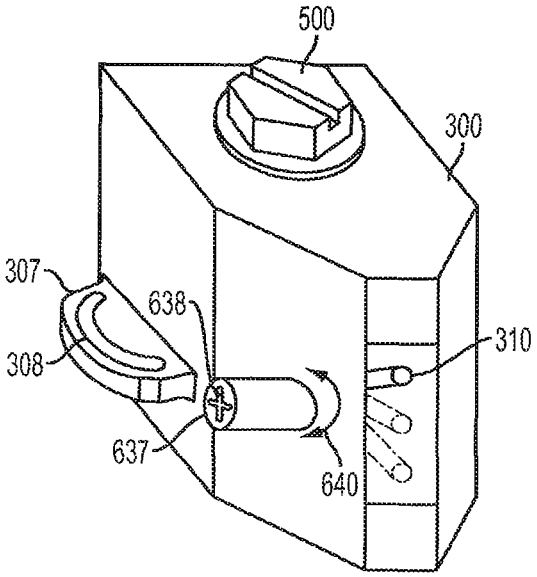
FIG. 6C is an isometric view of an exemplary surface disruptor with an manual adjustment mechanism for a trajectory adjustment mechanism.

FIGS. 6A-6C illustrate various embodiments of a trajectory adjuster 317. Referring to FIG. 6A, a cross section of the trajectory adjuster 317 within the disruptor 300 is shown. The trajectory adjuster 317 and housing of the disruptor 300 may be configured such that the fluid exiting the orifice 310 does not intersect with the edges of the housing of the disruptor 300 as the trajectory adjuster 317 rotates within the disruptor 300. In some embodiments, the rotational position of the trajectory adjuster 317 may be constrained by two or more stop tabs 600 and 602 situated about the trajectory adjuster 317. A cavity 607 within the disruptor 300 to house the trajectory adjuster 317 and may include one or more protrusions 605 that guide the rotational movement of the trajectory adjuster 317. The protrusions 605 may further make contact with the tabs 600 and 602 so as to limit the rotational movement of the trajectory adjuster 317 within the disruptor 300. The placement of the tabs 600 and 602 may be situated about the trajectory adjuster 317 to provide a variety of possible angular positions (shown in phantom) of an exit tube 316. These possible angular positions may be selected such that fluid exiting the orifice 310 does not intersect with one or more edges 610 of the housing of the disruptor 300. While the embodiment shown in FIG. 6A illustrates the tabs 600 and 602 situated about the trajectory adjuster 317 such that they straddle the protrusions 605, other embodiments are possible where tab 602 may be oriented in a different location about the valve and still maintain the desired angular rotation of the trajectory adjuster 317 (for example, tab 615 shown in phantom). A flexible tube 620 may couple a fluid channel 622 within the trajectory adjuster 317 to the fluid path of the disruptor 300, thereby allowing the trajectory adjuster 317 to be supplied with fluid as the trajectory adjuster 317 rotates within the disruptor 300 and transmits the fluid to the exit tube 316.

FIG. 6B illustrates a cross section of an alternative configuration of the trajectory adjuster 317. Referring to FIG. 6B, the trajectory adjuster 317 may include a single tab 625 that seats into a groove 630 of the disruptor 300. The trajectory adjuster 317 shown in FIG. 6B may be offset to the left of the disruptor 300 such that disruptor 300 does not obstruct the exit orifice 310 as the trajectory adjuster 317 rotates within the disruptor 300. The combination of the tab 625 and the groove 630 may act to limit rotational movement of the trajectory adjuster 317 within the disruptor 300 to prevent the orifice 310 from intersecting with the disruptor 300. The backside of the trajectory adjuster 317 may define a flat portion 632 that creates a bowl-shaped cavity 633. During operation of the laminar jet 115, the trajectory adjuster 317 is coupled to the fluid flow path 525 of the disruptor 300 through the cavity 633 as the trajectory adjuster 317 rotates within the disruptor 300. An O-ring 635 may be seated within the trajectory adjuster 317 at the edges of the flat portion 632 so as to prevent fluid from leaking from the cavity 633, around the periphery of the trajectory adjuster 317, and escaping around the front of the trajectory adjuster 317.

FIG. 6C illustrates a perspective view of the embodiment shown in FIG. 6A. As shown, the exit orifice 310 may be rotationally adjusted so as to define differing angular trajectories for fluid exiting the disruptor 300. The adjustment mechanism may include a cylindrically shaped knob 637 that rotates about an axis defined by the arrow 640. In some embodiments, the knob 637 may be hand operated, while in other embodiments the knob may include one or more slots 638 for insertion of a screw driver. In still other embodiments, an electrical servo may adjust the angular trajectory of fluid exiting the disruptor 300. It should be understood that similar control knobs or mechanisms could be similarly applied to the embodiment of FIG. 6B.

Although the present invention has been described with reference to preferred embodiments, persons skilled in the art will recognize that changes may be made in form and detail without departing from the spirit and scope of the invention. For example, while a subsurface water handling device has been discussed in detail, the principles disclosed herein may apply to water handling devices used at or above grade.

What is claimed is:

1. A method of operating a fluid handling device comprising a laminar jet, the method comprising passing a first stream of fluid through a plurality of filters in the laminar jet to reduce turbulence in the fluid;

ejecting the first stream of fluid from the laminar jet in a substantially laminar form;

ejecting a second stream of fluid from a surface disruptor, the surface disruptor mounted to the laminar jet;

intersecting the first stream of fluid with the second stream of fluid to disrupt a surface of the first stream of fluid; and adjusting an angle of intersection between the second stream of fluid and the first stream of fluid.

2. The method of claim 1 further comprising adjusting a force of the second stream of fluid.

3. The method of claim 2 further comprising adjusting a force of the first stream of fluid in conjunction with adjusting the force of the second stream of fluid.

4. The method of claim 1 further comprising adjusting a flow rate of the second stream of fluid.

5. The method of claim 1 further comprising modifying the laminarity of a surface of the first stream of fluid.

6. The method of claim 1 further comprising adjusting the second stream of fluid using a trajectory adjuster and a valve.

7. The method of claim 1 further comprising adjusting the second stream of fluid using a trajectory adjuster.

8. The method of claim 1 further comprising adjusting a flow rate of the first stream of fluid and the second stream of fluid to modify the laminarity of the first stream of fluid.

9. The method of claim 1 further comprising introducing light from a light source into the first stream of fluid, said light refracting outward from the first stream of fluid and enhancing illumination of the first stream of fluid.

10. A method of operating a fluid handling device comprising a laminar jet the laminar jet including an orifice and situated within a housing having a lid, the method comprising drawing a first stream of fluid into the laminar jet;

ejecting the first stream of fluid through the orifice of the laminar jet and out of the housing via an opening in the lid in a substantially laminar form;

disrupting a surface of the first stream of fluid with a second stream of fluid ejected from a surface disruptor mounted to the laminar jet by intersecting the first stream of fluid and the second stream of fluid;

adjusting an angle of intersection between the second stream of fluid and the first stream of fluid.

11. The method of claim 10, further comprising pressurizing the first stream of fluid before the stream enters the laminar jet.

12. The method of claim 10 further comprising adjusting a flow rate of the second stream of fluid to modify the laminarity of the first stream of fluid.

13. The method of claim 10 further comprising adjusting the angle of the laminar jet relative to the housing.

14. The method of claim 10 further comprising introducing light from a light source into the first stream of fluid, said light refracting outward from the first stream of fluid and enhancing illumination of the first stream of fluid.

15. The method of claim 10 wherein the angle of intersection between the second stream of fluid and first stream of fluid is adjusted using the surface disruptor attached to the laminar jet.

16. The method of claim 10 further comprising adjusting a flow rate of the first stream of fluid and the second stream of fluid to modify the laminarity of the first stream of fluid.

17. The method of claim 10 further comprising modifying the laminarity of the surface of the first stream of fluid.

18. The method of claim 10 further comprising adjusting the second stream of fluid using a trajectory adjuster.

19. The method of claim 18 further comprising adjusting the second stream of fluid using a valve.

* * * * *